United States Patent [19]

Brucken

[11] 4,144,005

[45] Mar. 13, 1979

[54] ROTARY THROUGH VANE COMPRESSOR

[75] Inventor: Byron L. Brucken, Miamisburg, Ohio

[73] Assignee: General Motors Corporation, Detroit, Mich.

[21] Appl. No.: 856,317

[22] Filed: Dec. 1, 1977

[51] Int. Cl.[2] ..... F04C 17/00; F04C 29/08

[52] U.S. Cl. ..... 418/255; 418/270

[58] Field of Search ..... 418/70, 236–238, 418/253, 254, 255, 257–259, 270

[56] References Cited

U.S. PATENT DOCUMENTS

| | | | |
|---|---|---|---|
| 2,260,888 | 10/1941 | Davis | 418/255 |
| 2,580,278 | 12/1951 | Brennan | 418/255 |
| 2,748,716 | 6/1956 | Janik | 418/255 |
| 3,676,021 | 7/1972 | Warner | 418/255 |
| 3,995,977 | 12/1976 | Takahasi et al. | 418/255 |

*Primary Examiner*—John J. Vrablik

*Attorney, Agent, or Firm*—Edward P. Barthel

[57] ABSTRACT

A rotary compact compressor having through vanes of fixed length slidably mounted in intersecting slots of a cylindrical rotor which rotates on an eccentric axis in a cylinder working chamber formed with a developed surface. The rotor includes an integral forwardly extending drive shaft which is supported in a cantilevered rotatable manner by single bearing means in a front head housing. The cantilevered rotor facilitates assembly of the through vanes by virtue of the rotor intersecting slots being open throughout their diametrical extent to the rotor rear face. The structure further includes a combined cover and valve plate enclosing the front face of the rotor housing section.

1 Claim, 5 Drawing Figures

ROTARY THROUGH VANE COMPRESSOR

This invention relates to rotary compressors and more particularly to a through vane rotary compressor for use with an automotive air conditioning system.

In developing rotary compressors for automotive air conditioning systems it is becoming increasingly important to provide a lightweight compressor with a compact design which occupies a minimal space in the engine compartment while requiring a minimum of parts to facilitate assembly. Through vane type rotary compressors conventionally employ a "straddle mounted" rotor requiring bearing means supporting both ends of the rotor as evidenced by U.S. Pat. No. 2,353,965 issued July 18, 1955 to Meadar and U.S. Pat. No. 2,448,233 issued Aug. 31, 1941 to Nyborg.

Accordingly, it is an object of the present invention to provide an improved through vane rotary compressor having a cantilever mounted rotor supported in the working chamber by means of a drive shaft integral with the rotor allowing the rotor to be rotatably supported by single bearing means, such that the rotor intersecting slots are open throughout their diametrical extent to the rotor rear face, whereby the through vanes are removably retained in their intersecting slots solely by a rear cover plate thereby reducing production cost and facilitating assembly.

It is still another object of the present invention to provide an improved through vane rotary compressor as set forth in the above object wherein the intake and discharge ports are both provided in a combined front cover and valve plate which closes the front end of the compressor working chamber.

Further objects and advantages of the present invention will become apparent from the following description wherein a preferred embodiment is disclosed.

Figure 1:
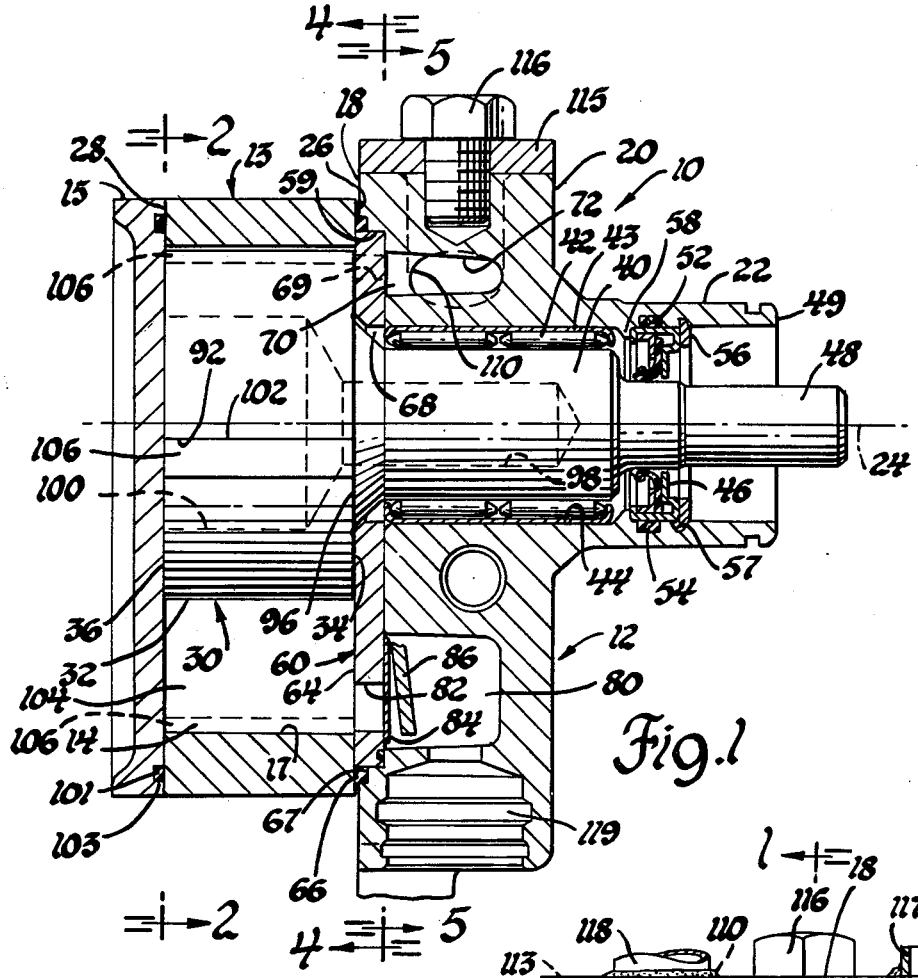
FIG. 1 is a sectional view through the compressor taken substantially along line 1—1 of FIG. 2.

Referring now to the drawings and more particularly to FIG. 1, there is shown a compressor generally indicated at 10 including a front head member 12, a cylindrical rotor housing section 13 defining a working chamber 14 and an end closure or rear end plate 15 serially arranged and secured together by four equally spaced bolts or cap screws indicated by numeral 16. The head member 12 is preferably formed from cast aluminum while the rotor housing section 13 and plate 15 are preferably formed as cast iron members.

The front head section 12 has a rearwardly directed continuous planar face 18 and a forwardly directed outer planar surface or front face 20 formed with a protruding integral tubular extension 22 thereon aligned on an axis 24 eccentric to the cylindrical rotor housing section 13. The cylindrical rotor housing section 13, defining the working chamber 14, has open ends terminating in forwardly and rearwardly directed peripheral edges 26 and 28, respectively. The contour of the working chamber surface 17 is a developed shape generated with a constant dimension from opposite points on the chamber wall measured on a straight line through the eccentric axis 24 of the compressor.

A rotor, generally indicated at 30, has a cylindrical peripheral surface 32 and opposed front 34 and rear 36 faces mounted for rotation in the working chamber 14 on the eccentric axis 24 by means of an integral drive shaft 40 extending forwardly from its front face 34. The rotor drive shaft 40 is rotatably mounted by single bearing means in the form of needle bearings 42 captured in an annular sleeve retainer 43 in a through bore 44. The bore, which extends through the head section 12 and the tubular extension 22, is aligned on the eccentric axis 24 such that the extension surrounds a portion of the rotor drive shaft free end driven by a prime mover, not shown. Sealing means in the form of an annular flexible seal assembly 46 surround the drive shaft reduced extension 48 adjacent its radiused juncture with the shaft bearing portion to thereby seal the bearings from the outer open end 49 of the through bore 44. Internal groove means 52 are provided in the bore 44 for an O-ring 54 forming a seal between the shaft seal assembly 46 and the bore. The shaft seal assembly 46 is retained by a snap ring 56, located in an annular bore groove 57, to maintain the seal assembly 46 against an inner annular rib 58 integrally formed in the through bore 44.

Figure 4:
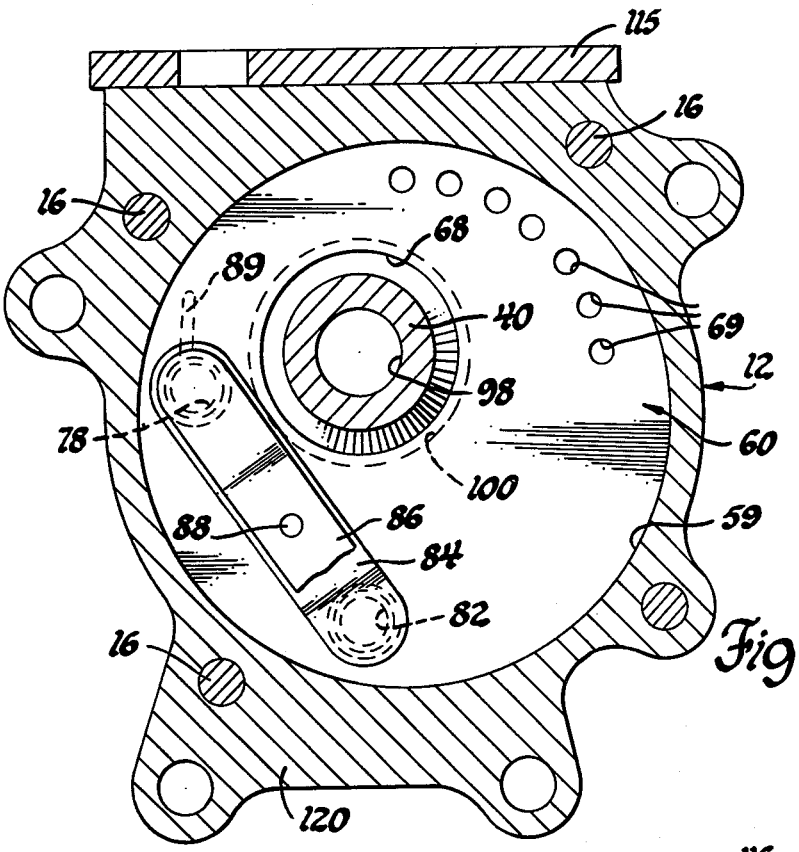
FIG. 4 is a sectional view taken substantially along the line 4—4 of FIG. 1, showing the valve plate.

As best seen in FIGS. 1 and 4, the front head section 12 rearwardly directed planar face 18 has an annular recess 59 sized in the disclosed form with an overall depth of about 4.80 centimeters, for the reception of a combined working chamber front end cover and valve plate 60 positioned in the recess between the front head 12 and rotor housing 13 sections. The front end plate 60, preferably formed of cast iron, is of a predetermined thickness, about 5.00 centimeters. Thus, with the plate 60 located in recess 59 its exposed flat surface 64 is set slightly above the front head section planar face 18 providing a sealing surface at the jointure of the plate surface 64 and rotor housing forwardly directed peripheral edge 26 to seal the working chamber 14. An O-ring seal 66 seated in a counterbore groove 67 of recess 59 provides a seal to the atmosphere.

Figure 5:
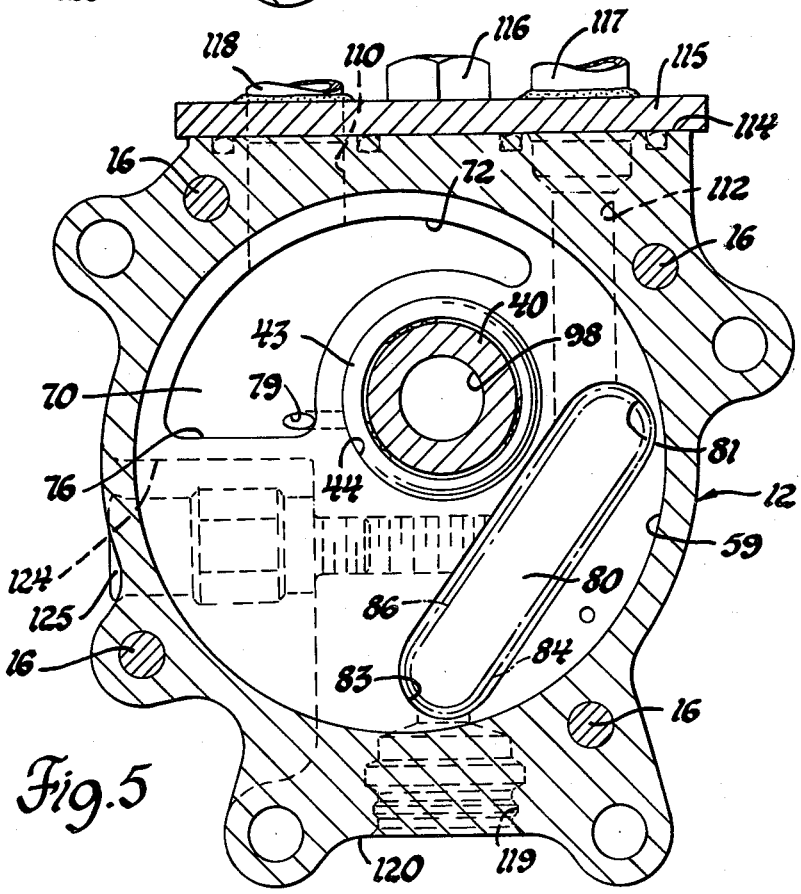
FIG. 5 is a vertical sectional view taken substantially along the line 5—5 of FIG. 1 showing the front head inner face.

The front cover and valve plate 60, as seen in FIG. 4, has a large eccentric opening 68 therethrough for reception of the rotor shaft 40. In addition the plate 60 has first suction inlet aperture means, which in the disclosed form comprise a plurality of circular apertures 69, with their centers located on an arcuate path of a predetermined extent so as to communicate with a suction cavity 70 formed in the front head section 12, with the suction cavity having an open side located in the annular front head recess 59. As seen in FIG. 5, the suction cavity 70 has a generally horn-shaped configuration such that it increases in dimension in the direction of rotation of the rotor from its small end 72, located adjacent to and just past the pinch-point or throat 74 of the compressor chamber 14. The suction cavity extends through an arc to its large end and terminates in a planar surface 76 located substantially in a radial direction of the working chamber 14. FIG. 5 shows a lubrication passage 79 in the front head providing communication between a location adjacent the suction cavity surface 76 to the through bore 44 to allow oil to flow to the bearing 42.

The front cover and valve plate 60 has second aperture means in the form of a discharge port 78 communicating with a discharge cavity 80 formed in the recess 59 of the head section having radiused ends. As best seen in FIG. 5, the elongated discharge cavity 80 is oriented with its principal axis aligned on a cord of the annular recess 59 providing a location on the compression side of the working chamber 14. The plate discharge port 78 is concentrically disposed with the discharge cavity one radiused end 81 at an arcuate location spaced approximately 40° about the axis 24 from the chamber pinch-point 74. The opposite radiused end 83 of the discharge cavity is concentrically disposed relative to a slugging discharge port 82 in the front cover and valve plate 60.

Figure 2:
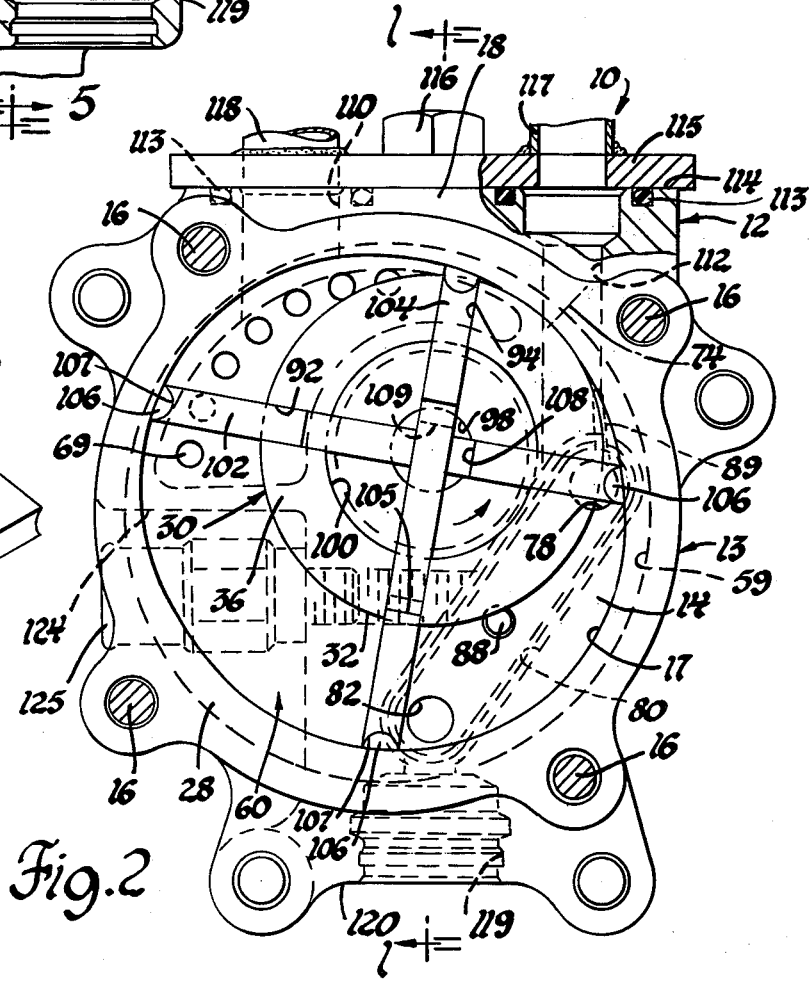
FIG. 2 is a vertical sectional view taken substantially along the line 2—2 of FIG. 1.

As seen in FIGS. 1 and 2, the discharge port 78 and slugging port 82 are each closed by a single elongated reed valve 84 which is retained by means of a coextensive valve retainer 86. The reed valve 84 and retainer 86 are secured to the plate 60 by suitable means such as by a rivet or threaded machine bolt 88. FIGS. 2 and 4 show a groove 89 formed on the inner surface of the valve plate 60 which allows any trapped liquid to adjacent pinch-point 74 to return to the discharge cavity 80 via port 78 to insure against hydraulic lock developing in the compressor.

As best seen in FIG. 2, the rotor 30 includes a pair of diametrical intersecting slots 92 and 94 formed in the rotor with the open end of the slots located in the rearward face 36 of the rotor. The rotor slots 92, 94 extend forwardly from the rearward face 36 a predetermined distance such that the slots' bottom or forward closed ends 96 are positioned substantially in the plane of the rotor forward face 34. The rotor 30 has a central coaxial bore 98 (FIG. 1) extending forwardly from its rearward face 36 to the rotor shaft 40. The rotor bore 98 has a counterbored portion 100 concentric with the rotor formed with a predetermined diameter which allows for relative movement between through blades or impeller vanes to be described.

The rear closure plate 15 is positioned in flush engagement with the rotor section rearward facing peripheral edge 28 and sealed thereto by O-ring 101 located in plate groove 103. It will thus be seen that the rotor intersecting slots 92 and 94 are open throughout their diametral extent to the rotor rear surface 36 such that through vanes 102 and 104, positioned in slots 92 and 94 respectively, are removably retained in their slots in the rearward direction solely by the rear closure plate 15.

Figure 3:
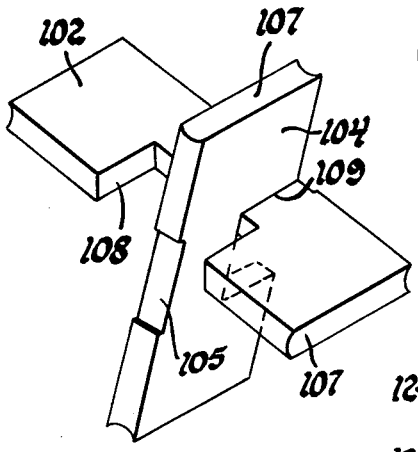
FIG. 3 is a perspective view of the through-vanes.

FIG. 3 shows the vanes 102, 104 in the form of U-shaped slider vanes having a length to maintain their opposite vane tip seals 106 in contact with the developed wall surface 17 of the working chamber 14. It will be seen in FIG. 2 that the seals 106 have a semi-circular inner convex section for reception in complementary vane concave cylindrical socket edges 107. The contour of the vane tip seals 106 at their chamber wall contacting portion eliminates vane skip by means of a developed contour which is achieved from the wear pattern of the seal. The result is a pressure responsive seal element between the ends of the vanes and the chamber wall 17 that reduces break-in wear and loose fitting conditions in the manner of a piston ring operating in a reciprocating compressor. The seals' 106 semi-circular section provides for rotational movement of the seals 106 in their concave sockets 107 causing the seals' developed contour to track the chamber wall 17 developed surface resulting in improved seal life. The seals may be formed of suitable material such as an aluminum-bronze alloy. The U-shaped vanes 102 and 104 are formed with slots 108 and 109 respectively, so that the vanes may pass each other in the rotor counterbore region 100 without interfering with their relative sliding movement. Notched areas 105 are provided in the vanes to reduce frictional contact with the rear closure 15.

As viewed in FIG. 5, the front head section has first and second passage means in the form of first suction inlet passage 110 and second discharge exit passage 112 the inner ends of which communicate with the suction 76 and discharge cavities, respectively. As best seen in FIG. 2, the first and second passages have their open ends located in a planar surface 114 of the compressor front head such that the rotary compressor can be connected to intake and discharge tubes from the refrigeration system to provide adjacent side entrance locations in the front head 12. An attachment plate 115 is provided for surface 114, secured to the front head by bolt 116. A discharge tube 117 and a suction tube 118 are secured, as by welding, to the outer face of plate 115 while O-ring seals 113 are provided in annular grooves around the exits of passages 110 and 112 in the surface 114. As seen in FIG. 2 a socket 119 is formed in front housing side wall 120 for receiving a high temperature cut-off switch, not shown. Similarly, a recess 124 is formed in the front housing for reception of a high pressure relief valve 125.

It will be appreciated that an additional feature of applicant's novel compressor with a cantilevered supported integral rotor 30 and shaft 40 insures correct alignment of the rotor 30 in relation to the working chamber 14 and rear closure plate 15 for efficient assembly of the compressor.

While the embodiment of the present invention as herein disclosed constitutes a preferred form, it is to be understood that other forms might be adopted.

I claim:

1. In a rotary compressor of the through vane type including a cylindrical rotor housing section defining a working chamber, said rotor housing section having open ends terminating in forwardly and rearwardly directed peripheral edges, a rotor having a substantially cylindrical peripheral surface and opposed front and rear faces mounted for rotation in said working chamber on an axis eccentric to said cylindrical rotor housing section, a pair of diametrical intersecting slots formed in said rotor, a through vane slidably mounted in each said slot and having a predetermined length dimension, the wall of said working chamber at opposite sides thereof having a contour generated at the ends of a constant length dimension line through said eccentric axis of rotation of said rotor so as to maintain the vane opposite edges in contact with said working chamber wall, the improvement wherein said rotor has an integral drive shaft extending forwardly from its front face, a front cylindrical head section having a longitudinal through bore aligned on said eccentric axis, said front head section having a forwardly directed outer surface formed with a protruding integral tubular extension thereon aligned on said eccentric axis, said head section having a rearwardly directed planar face formed with an annular recess of a predetermined depth, a suction cavity and a discharge cavity formed in said head section, each said suction and discharge cavity having an open side located in said recess, a combined working chamber front cover and valve plate positioned in said recess between said head and rotor sections, said plate having a thickness substantially equal to but greater than the depth of said recess whereby the exposed face of said plate extends a predetermined distance beyond said front head section planar face so as to provide a common plane sealing surface at the jointure of said plate and said rotor housing section forward peripheral edge, a rear cover plate positioned in flush sealing engagement with said rotor section rearward facing peripheral edge, said valve plate having first aperture means communicating with said suction cavity and said working chamber, said valve plate having second aperture means communicating with said discharge cavity and said working chamber, discharge valve means on said valve plate operative to control flow through said second aperture means, said front head section having first and second passage means communicating with said suction and discharge cavities, said valve plate having an eccentric opening therethrough, said rotor drive shaft extending through said valve plate eccentric opening and received in said head section through bore such that said tubular extension surrounds a portion of said rotor drive shaft free end, means interconnecting said front head section, said rotor housing section and said rear cover plate; single journal bearing means positioned in said through bore around said rotor drive shaft whereby said rotor is rotatably supported in cantilevered fashion in said working chamber on said eccentric axis, and said rotor intersecting slots open throughout their diametrical extent to said rotor rear face whereby said through vanes are removably retained in said intersecting slots in the rearward direction solely by said rear cover plate.

* * * * *